US011473568B2

(12) United States Patent
Lev et al.

(10) Patent No.: US 11,473,568 B2
(45) Date of Patent: Oct. 18, 2022

(54) APPARATUS AND METHOD FOR OPERATING A HEATERLESS HOLLOW CATHODE, AND AN ELECTRIC SPACE PROPULSION SYSTEM EMPLOYING SUCH A CATHODE

(71) Applicant: Rafael Advanced Defense Systems LTD., Haifa (IL)

(72) Inventors: Dan Lev, Haifa (IL); Demitiri Mikitchuk, Haifa (IL); Alon Gal, Haifa (IL)

(73) Assignee: RAFAEL ADVANCED DEFENSE SYSTEMS LTD., Haifa (IL)

( * ) Notice: Subject to any disclaimer, the term of this patent is extended or adjusted under 35 U.S.C. 154(b) by 266 days.

(21) Appl. No.: 16/771,737

(22) PCT Filed: Dec. 12, 2017

(86) PCT No.: PCT/IL2017/051341
§ 371 (c)(1),
(2) Date: Jun. 11, 2020

(87) PCT Pub. No.: WO2019/116361
PCT Pub. Date: Jun. 20, 2019

(65) Prior Publication Data
US 2021/0071650 A1 Mar. 11, 2021

(51) Int. Cl.
*F03H 1/00* (2006.01)
*H01J 27/02* (2006.01)
*H05H 1/54* (2006.01)

(52) U.S. Cl.
CPC ..... *F03H 1/0068* (2013.01); *F03H 1/0025* (2013.01); *H01J 27/022* (2013.01); *H05H 1/54* (2013.01)

(58) Field of Classification Search
None
See application file for complete search history.

(56) References Cited

PUBLICATIONS

Lev "Development of a Low Current Heaterless Hollow Cathode for Hall Thrusters" (Year: 2015).*
Han "Physical Processes in Hollow Cathode Discharge" (Year: 1990).*
Trent "Control of the Electron Energy Distribution Function (EEDF) in a Hall Thruster Plasma" (Year: 2016).*

* cited by examiner

*Primary Examiner* — Arun Goyal
*Assistant Examiner* — William L Breazeal
(74) *Attorney, Agent, or Firm* — Mark M. Friedman

(57) ABSTRACT

A heaterless hollow cathode provides electron emission current in an electric space propulsion system. A mechanical, thermal, and electromagnetic design of the cathode apparatus is presented, and a method of operation for rapid ignition and stabilization of the cathode is provided. The keeper of the cathode apparatus has a thickness change which reduces the flow of heat away from the cathode's emitter assembly. The method for heating the emitter assembly includes controlling applied voltages so that the current flowing from the emitter assembly to the keeper is maintained at a predetermined fixed value. By this method, damage to the electron emitting surfaces of the emitter assembly by electric arcing and/or by depletion of dopant materials is avoided.

16 Claims, 6 Drawing Sheets

4

APPARATUS AND METHOD FOR OPERATING A HEATERLESS HOLLOW CATHODE, AND AN ELECTRIC SPACE PROPULSION SYSTEM EMPLOYING SUCH A CATHODE

FIELD AND BACKGROUND OF THE INVENTION

The invention relates to electric space propulsion systems, and specifically, to the construction and operation of a heaterless hollow cathode (hereinafter HHC) for such systems. Recent developments in the technology of HHC's for use in electric space propulsion systems are described in a non-patent reference entitled "Heaterless Hollow Cathode Technology—A Critical Review," Proceedings of the Space Propulsion 2016 Conference, 2-6 May 2016, Rome, Italy, SP2016_3125366, which is hereby incorporated herein by reference in its entirety.

The operation of an HHC consists of three phases: (1) ignition through high-voltage breakdown of a neutral gas, (2) cathode heating either by glow discharge and/or by electric arc, and (3) continuous self-sustained cathode emission. The stochastic physical nature of discharge phenomena in gases may lead to failure of the HHC during any one of the three phases of operation. A large body of academic research has succeeded in identifying many of the failure mechanisms that have been observed during HHC operation.

In the prior art, an HHC having a configuration known as an "Open-End Emitter—Orificed Keeper" has been disclosed in U.S. Pat. No. 4,475,063 to Graeme Aston, entitled "Hollow Cathode Apparatus," dated Oct. 2, 1984. This configuration has been tested experimentally and various failure mechanisms have been observed.

For example, erosion of the hollow electron emitter by ion bombardment may reduce the overall HHC lifetime. In some cases, catastrophic destruction of the emitter may be caused by high current arcing between the emitter and keeper.

Another source of HHC failure is connected with the mass flow of the gas propellant. When the inner diameter of the emitter is small, the HHC is susceptible to plugging. When the inner diameter of the emitter is large, the gas pressure may be too low for ignition. If the gas pressure is increased by increasing the mass flow of the gas propellant, the increased mass flow rapidly depletes the supply of gas propellant and also may lead to plasma instability during the third phase of HHC operation. If, instead of increasing mass flow, the ignition voltage, thus energy, is increased to compensate for low gas pressure, there is an increased risk of emitter damage by high-voltage arcing between the emitter and keeper.

Still another source of premature failure occurs during the third phase of operation, i.e. the continuous self-sustained cathode emission phase. It is believed that such failures are due to thermal stresses and melting of the emitter caused by excessively high operating temperatures (e.g. greater than 2,500 degrees Celsius). Such high temperatures are often reached in order to attain thermionic emission from emitters having a high work function (e.g. above 4 eV), such as those made of pure Tantalum or pure Tungsten. In an effort to lower their work function, emitters are sometimes impregnated with dopant materials, such as Barium Oxide or Scandium Oxide. However, even doped emitters have been observed to fail prematurely because of thermal stresses and melting. It is thought that this is may be due to depletion of the dopant material after extended operation of the emitter at a high electron surface current density. Once the dopant has been depleted, the emitter work function increases to the level of the pure metal, and excessively high temperatures are again needed to achieve thermionic emission, together with the attendant risk of thermal failure.

SUMMARY OF THE INVENTION

The present invention is an apparatus and method for operating a heaterless hollow cathode.

According to the teachings of an embodiment of the present invention, there is provided a heaterless hollow cathode apparatus including:

- an emitter assembly with an electron emitter and an emitter holder, and a gas flow path passing through the emitter assembly and an emitter orifice;
- a keeper surrounding the emitter assembly, and having a keeper orifice;
- a gas flow regulator for supplying a regulated flow of gas through the gas flow path;
- an electrical power supply; and
- a controller electrically associated with the electrical power supply, the gas flow regulator, the keeper, and the emitter assembly, wherein the controller is configured sequentially to:
  - apply an emitter-keeper voltage between the emitter assembly and the keeper while gas is supplied to a volume between the emitter assembly and the keeper to initiate a discharge between the emitter assembly and the keeper;
  - monitor the value of an emitter-keeper current, flowing between the emitter assembly and the keeper, and adjust the emitter-keeper voltage so as to maintain the emitter-keeper current at a predetermined current value;
  - monitor the emitter-keeper voltage so as to detect a drop in the emitter-keeper voltage to values which remain below a predetermined voltage threshold for a predetermined minimum time duration;
  - actuate a main discharge circuit in which current flows from an anode to the heaterless hollow cathode; and
  - set the emitter-keeper voltage to zero.

According to one feature of certain preferred implementations of the apparatus, the emitter holder includes an emitter holder neck which encapsulates the electron emitter.

According to a further feature of certain preferred implementations of the apparatus, the area of the keeper orifice is between 5% and 25% of the area of the emitter orifice.

According to a further feature of certain preferred implementations of the apparatus, the keeper includes a change in thickness.

According to a further feature of certain preferred implementations of the apparatus, the electron emitter is either a refractive ceramic material or a refractive metal impregnated with an oxide.

According to a further feature of certain preferred implementations of the apparatus, the electron emitter has a work function less than 2.2 electron volts.

According to a further feature of certain preferred implementations of the apparatus, the controller detects initiation of the discharge between the emitter assembly and the keeper by identifying a sudden sharp increase in the emitter-keeper current.

According to a further feature of certain preferred implementations of the apparatus, the above predetermined current value is in a range of 100 to 150 milli-amperes.

According to a further feature of certain preferred implementations of the apparatus, the above predetermined voltage threshold is in a range of 50 to 100 volts.

According to a further feature of certain preferred implementations of the apparatus, the above predetermined minimum time duration is in a range of 1 to 3 seconds.

There is also provided according to the teachings of an embodiment of the present invention, a method for operating a heaterless hollow cathode including the steps of:

providing a controller electrically associated with an electrical power supply, a gas flow regulator, a keeper, and an emitter assembly;

applying an emitter-keeper voltage between the emitter assembly and the keeper to initiate a discharge between the emitter assembly and the keeper;

monitoring the value of an emitter-keeper current, flowing between the emitter assembly and the keeper, and adjusting the emitter-keeper voltage so as to maintain the emitter-keeper current at a predetermined current value;

monitoring the emitter-keeper voltage so as to detect a drop in the emitter-keeper voltage to values which remain below a predetermined voltage threshold for a predetermined minimum time duration;

actuating a main discharge circuit in which current flows from an anode to the heaterless hollow cathode; and setting the emitter-keeper voltage to zero.

According to one feature of certain preferred implementations of the method, the controller detects initiation of the discharge between the emitter assembly and the keeper by identifying a sudden sharp increase in the emitter-keeper current.

According to a further feature of certain preferred implementations of the method, the above predetermined current value is in a range of 100 to 150 milli-amperes.

According to a further feature of certain preferred implementations of the method, the above predetermined voltage threshold is in a range of 50 to 100 volts.

According to a further feature of certain preferred implementations of the method, the above minimum time duration is in a range of 1 to 3 seconds.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is an HHC apparatus and method of operation. The principles of the present invention may be better understood with reference to the drawings and the accompanying description.

Figure 1:
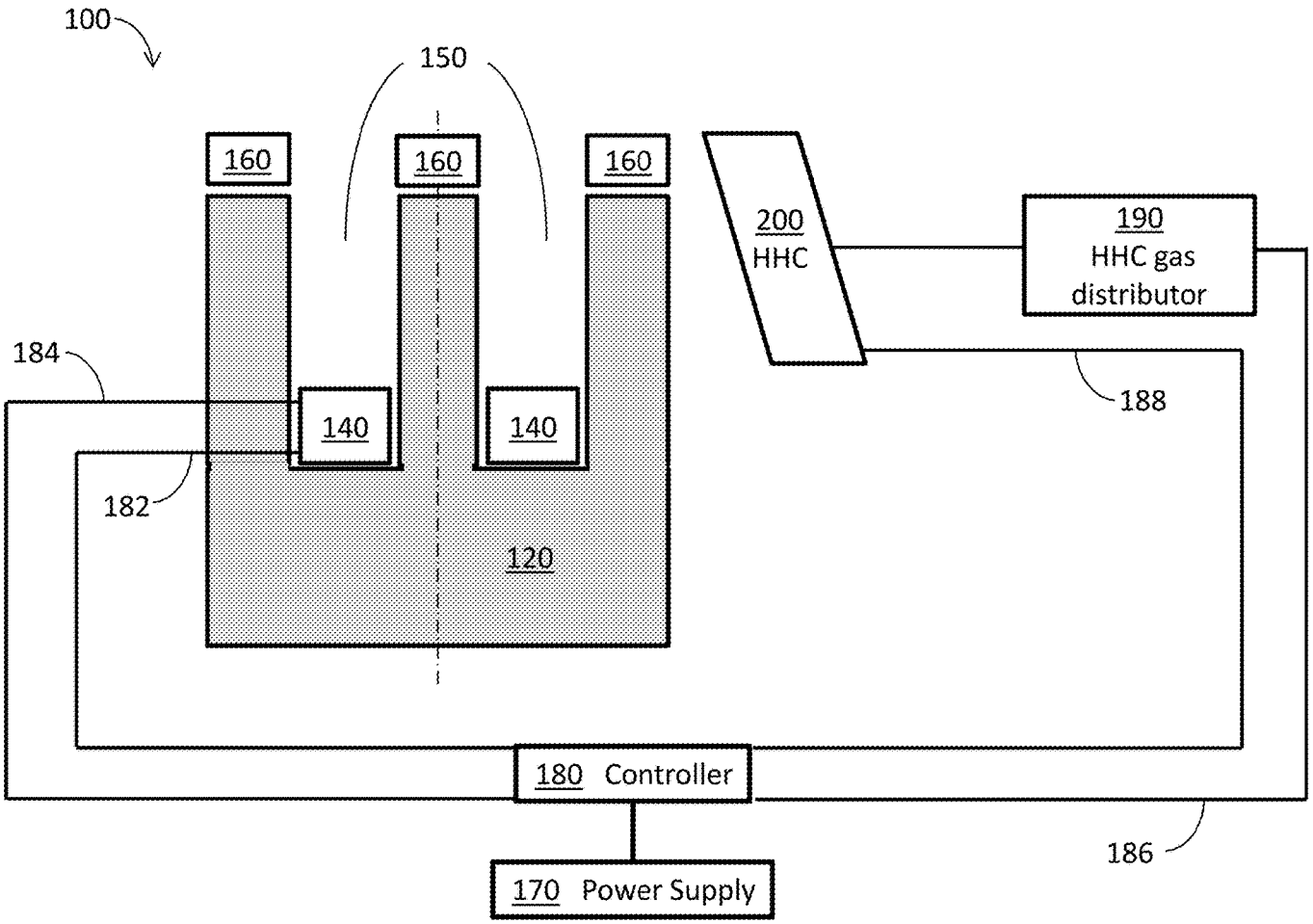
FIG. 1 is a block diagram of an exemplary electric space propulsion system according to an embodiment of the invention.

Referring now to the drawings, FIG. 1 is a block diagram of an exemplary electric space propulsion system 100 according to an embodiment of the invention. Mechanical support 120 is typically cylindrically symmetric with respect to a central axis shown by the dot-dash line. Anode element 140 is both a positive electrical terminal and a propellant gas distributor for electric space propulsion system 100. The propellant gas flowing through anode element 140 is preferably a non-corrosive, easily ionized gas having a high molecular weight, such as Xenon, Krypton, or Argon. HHC gas distributor 190 supplies a neutral gas to HHC 200, which is the same as or different from the propellant gas. The HHC gas is preferably a non-corrosive, easily ionized gas, such as Xenon, Krypton, Argon, Helium, Neon, Hydrogen, or Nitrogen.

Power supply 170 provides electrical voltages and currents required by controller 180. Controller 180 contains at least one processor and at least one data storage element, a timing mechanism, and a multiplicity of electrical interfaces to sensors and actuators. The electrical interfaces associated with anode element 140, HHC gas distributor 190, and HHC 200 are represented schematically in FIG. 1 by lines 182, 184, 186, and 188, respectively. Electrical interfaces 182 and 184 provide signals to control the anode voltage and the mass flow rate of the propellant gas, respectively. Electrical interfaces 186 and 188 provide signals to control the mass flow rate of the HHC gas and the voltages required by HHC 200, respectively. Controller 180 is preferably configured, by a dedicated hardware implementation, or by software running on a general purpose processor, or by any combination thereof, to perform all of the steps needed to operate system 100 and HHC 200. Power supply 170 and/or controller 180 may be configured as dedicated components or, alternatively, as components integrated with a spacecraft platform that performs other functions, in addition to those associated with electric space propulsion system 100.

During the operation of system 100, a stream of electrons exits HHC 200 and travels towards anode element 140 in response to an applied electric field. The latter, in conjunction with an orthogonal magnetic field established by magnetic poles 160, creates a circulating Hall electron current. The latter collides with and ionizes neutral propellant gas molecules flowing through anode element 140. The ionized propellant gas molecules are accelerated to high velocities by an applied electric field and pass through discharge channel 150. On exiting system 100, the ionized propellant gas molecules are neutralized by electrons emitted by HHC 200.

System 100 is known to those skilled in the art as a Hall effect thruster, and is mentioned here as one preferred but non-limiting example of electric space propulsion systems which employ an HHC. The scope of the present invention is not limited to such an example, and includes embodiments employing any and all types of electric space propulsion system which utilize an HHC apparatus and/or method of operation according to this invention.

Figure 2:
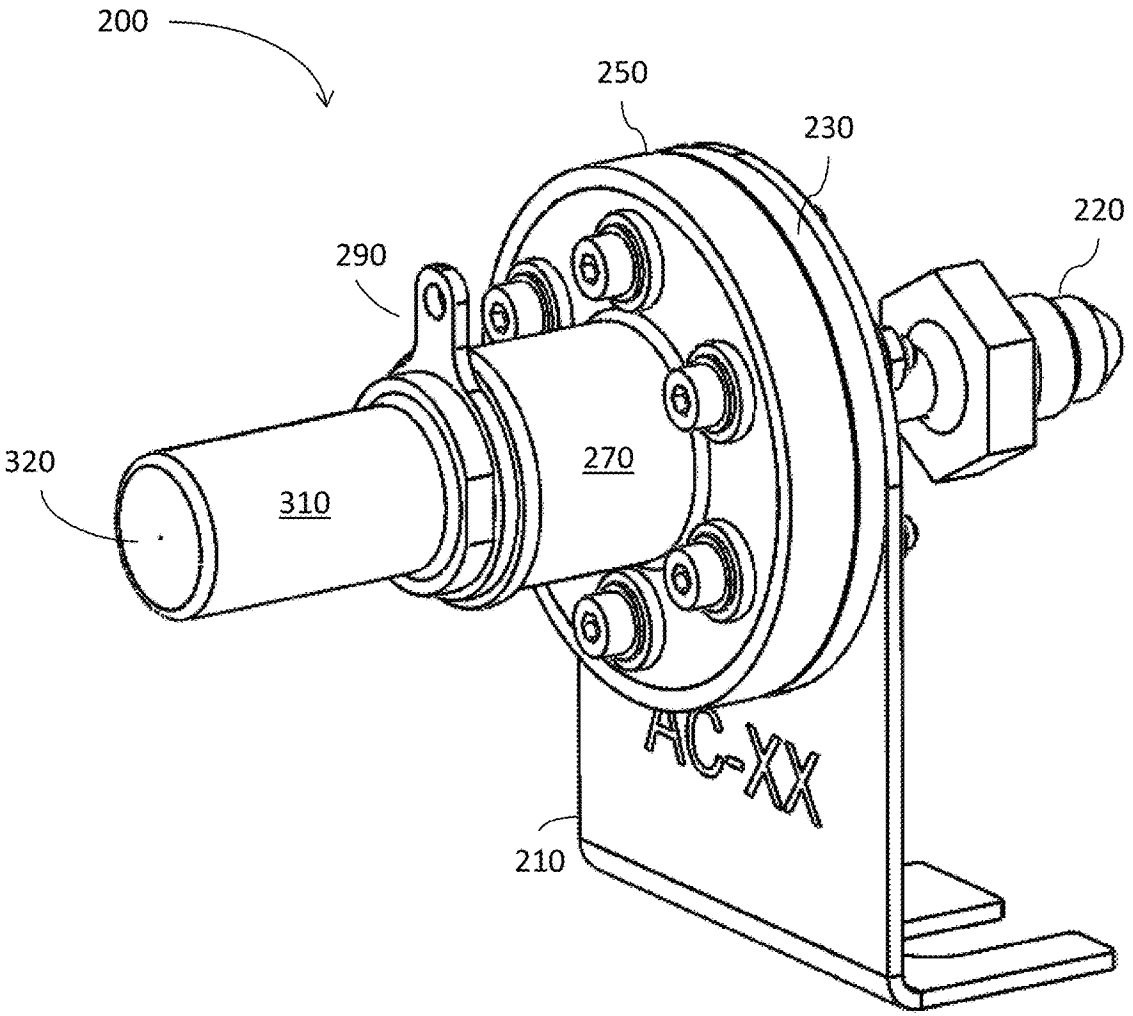
FIG. 2 is a perspective external view of an exemplary HHC, according to an embodiment of the invention.

The structure of an exemplary implementation of HHC 200 is illustrated in FIGS. 2-5, where the same reference numerals will be used throughout. FIG. 2 is a perspective external view of an exemplary HHC, according to an embodiment of the invention. HHC 200 is mechanically supported by HHC bracket 210, which is affixed to mechanical support 120. Neutral gas enters HHC 200 through gas connector 220. Insulating discs 230 and 250 provide electrical insulation for internal elements. Cylindrical collar 270 and keeper 310 are made of conducting material and are at a common electric potential. Fixture 290 is an electrical contact ring which is in physical contact with keeper 310.

Figure 3:
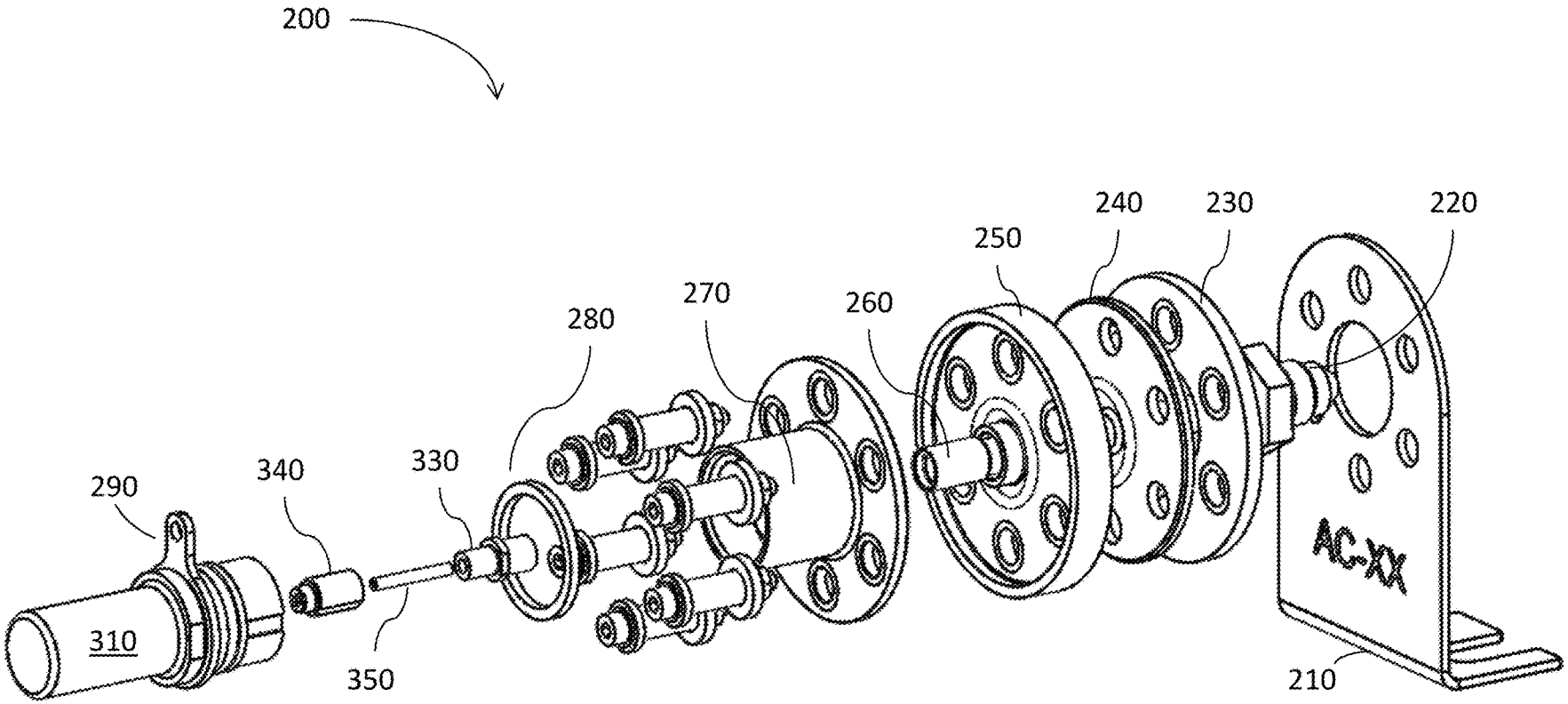
FIG. 3 is a perspective exploded view of the exemplary HHC of FIG. 2.

FIG. 3 is a perspective exploded view of exemplary HHC 200. Flange 240 is integrally formed with or rigidly connected to gas flow tube 260, and both are preferably made of stainless steel. Vacuum seal 280 isolates the pressure inside keeper 310 from the pressure external to keeper 310. A gas pressure sensor [not shown] preferably monitors the gas pressure inside keeper 310. Emitter base 330 is connected to emitter holder 340 which surrounds electron emitter 350. Parts 330, 340 and 350 are at a common electric potential, and are collectively termed an "emitter assembly".

Figure 4:
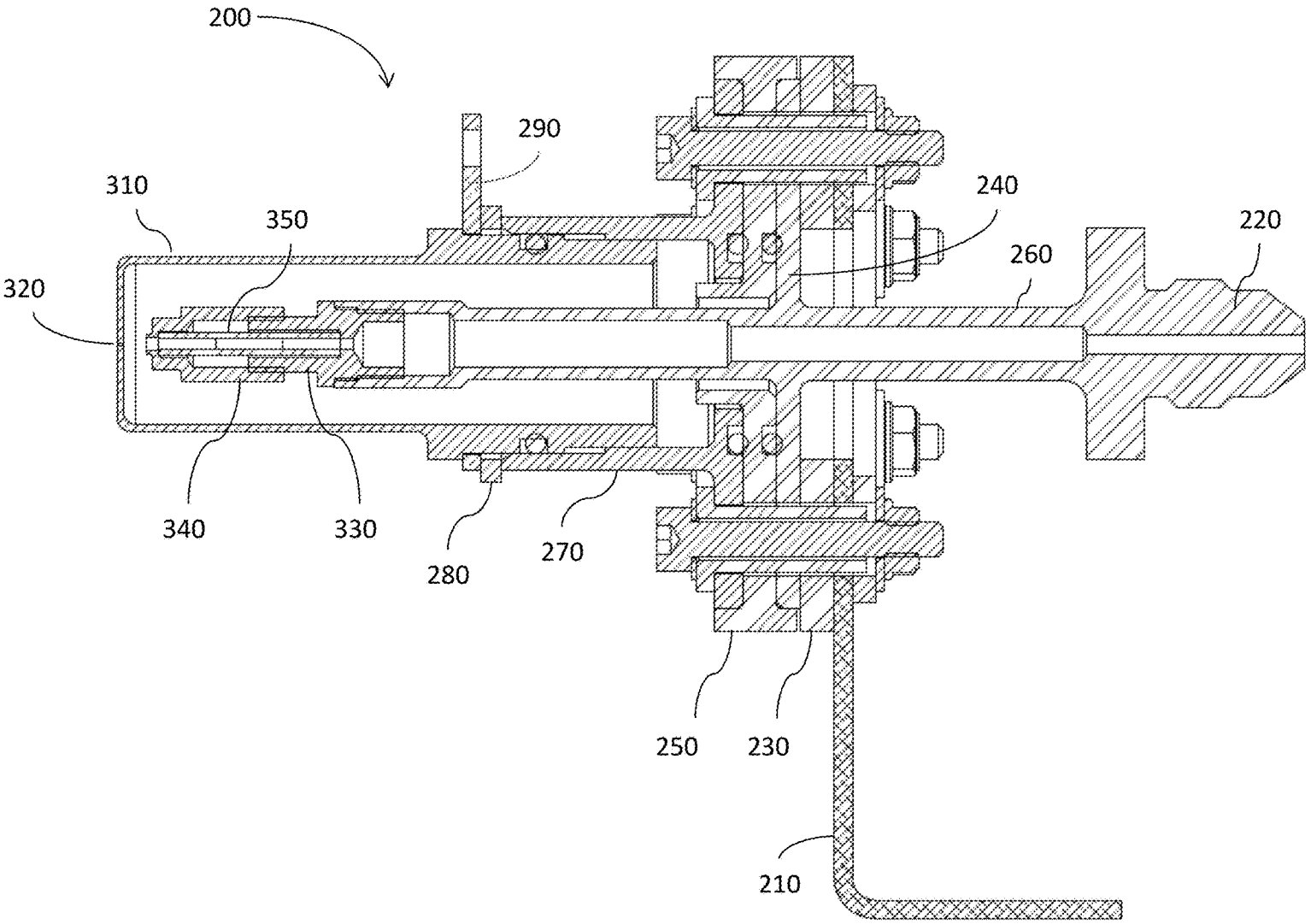
FIG. 4 is an axial cross-sectional diagram of the exemplary HHC of FIG. 2.
Figure 5:
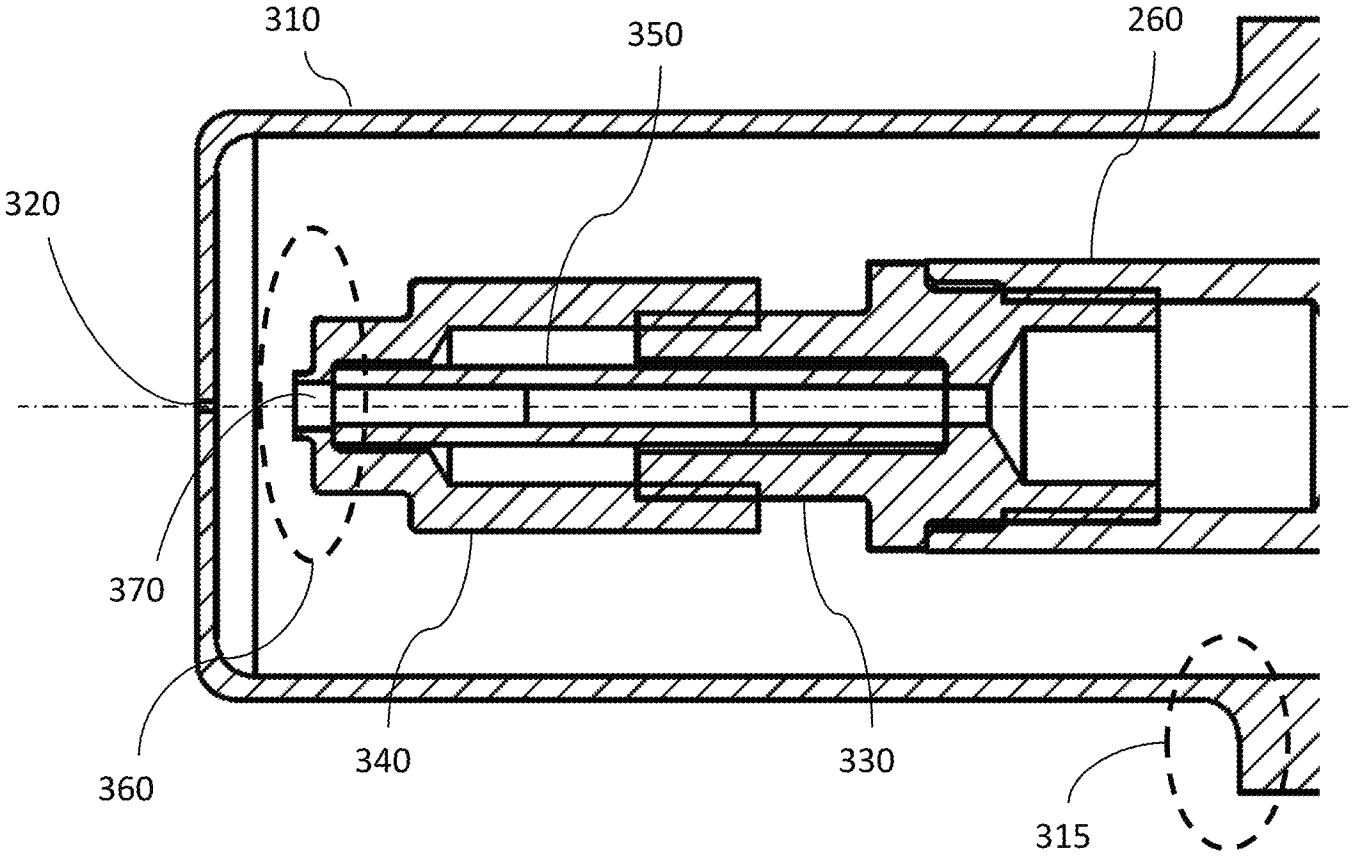
FIG. 5 is an enlarged axial cross-sectional diagram of the exemplary HHC of FIG. 2.

FIG. 4 is an enlarged axial cross-sectional diagram of HHC 200, showing details of an emitter assembly according to an embodiment of this invention. The dot-dash line represents a central axis of the emitter assembly. The overlapping area between emitter base 330 and emitter holder 340 represents any suitable mechanical interconnection which provides close electrical and thermal contact between the two parts, such as a threaded, brazed, or welded connection. Labels 320 and 370 denote a keeper orifice and an emitter orifice, respectively. The word "orifice" as used herein in the description and claims denotes a geometric opening, having no material composition, which is preferably circular in shape. The area of keeper orifice 320 is preferably in the range of 5% to 25% of the area of emitter orifice 370. The shape of emitter holder neck 360 is designed to encapsulate electron emitter 350, so as to absorb the initial high voltage pulse between the emitter assembly and keeper; as well as to allow simple emitter integration into the cathode that does not require welding or brazing of the emitter.

The thermal properties and design of HHC 200 are preferably configured to avoid premature failure due to thermal stress or melting. The material composition of keeper 310 is preferably a refractory metal having a low thermal conductivity (e.g. less than or equal to 180 watts per meter per degree Celsius at a peak temperature of 500 degrees Celsius). Tungsten, Molybdenum, and Tantalum are examples of such refractory metals. To avoid thermal cracking at high temperatures, keeper 310 should not consist of brazed components, but rather should be a single machined structure. Keeper thickness change 315 reduces the flow of heat away from the emitter assembly by reducing the cross-sectional area for heat conduction through keeper 310. The material composition of emitter base 330 and emitter holder 340 is preferably a refractory metal, which may be the same as or different from that of keeper 310. Coefficients of thermal expansion are preferably matched between the refractory metals so as to minimize thermal stress. With proper thermal design as described (choice of materials, wall thickness etc.), the HHC of this invention has been shown to provide continuous self-sustained cathode emission, at a stable electron current, for more than 1500 hours of operation.

Electron emitter 350 is preferably a material having a threshold temperature for thermionic emission below 1800 degrees Celsius and a melting point above 2000 degrees Celsius. Typically, this can be achieved with an emitter material having a work function which is less than 2.2 electron volts. One such material is the refractory ceramic Lanthanum Hexaboride; another is Tungsten impregnated with an oxide dopant, such as Barium Oxide or Scandium Oxide.

Figure 6:
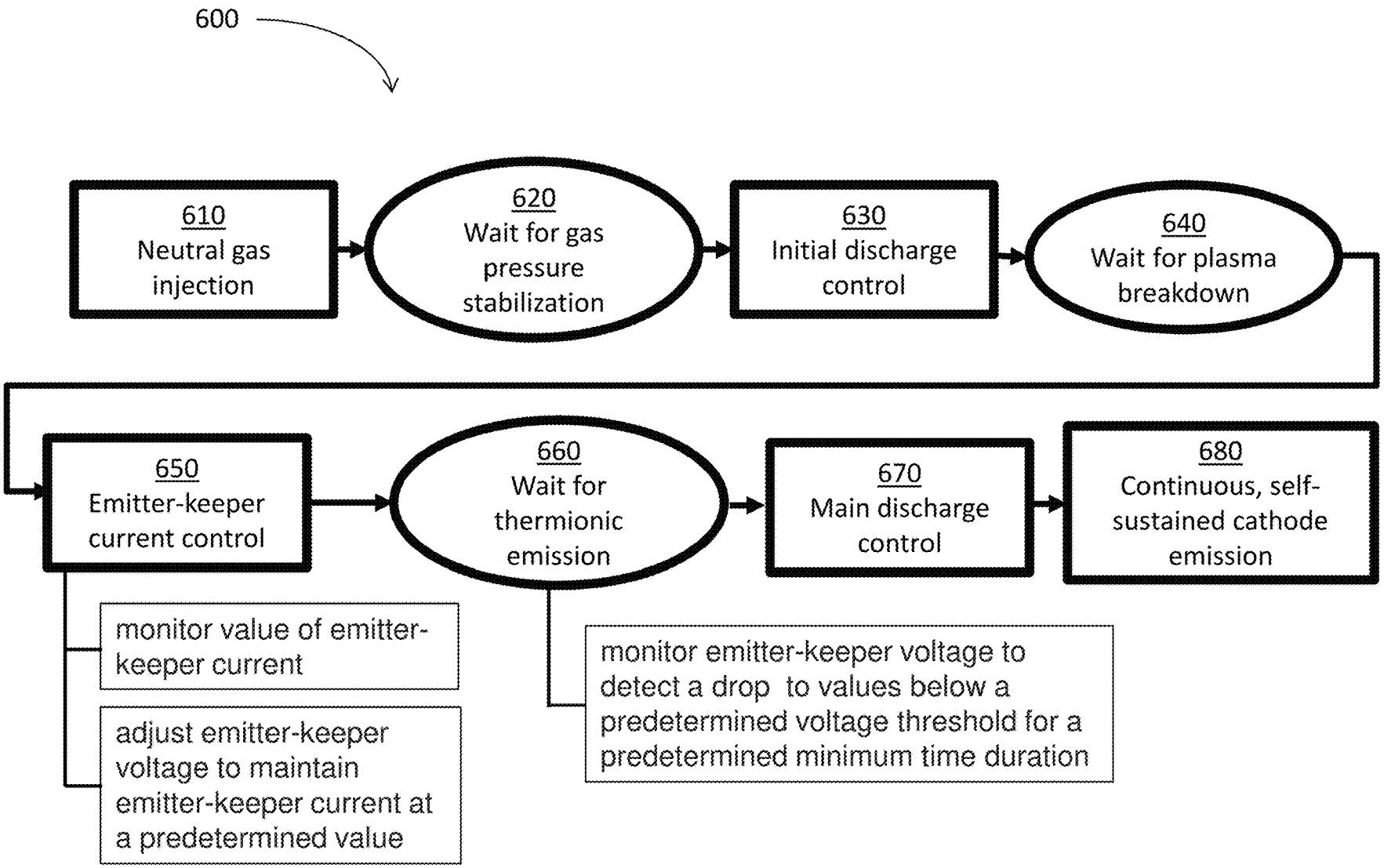
FIG. 6 is a block diagram of an exemplary method of operation of an HHC, according to an embodiment of the invention.

FIG. 6 is a block diagram illustrating the operation of an HHC under the control of controller 180, also corresponding to an exemplary method of operation of an HHC, according to the teachings of an embodiment of the invention. According to FIG. 6, operation of the HHC begins with block 610, namely the injection of neutral gas at a predetermined mass flow rate through gas connector 220. The gas passes through emitter orifice 370 and fills the evacuated volume inside keeper 310. Controller 180 preferably monitors the gas pressure until it stabilizes at a mean value. "Stabilizing" in this context may be defined by any suitable criterion such as, for example, when fluctuations in pressure are within±1% of the mean value. Typical but non-limiting exemplary values of mass flow and of stable gas pressure are 0.1 to 1 milligrams per second and 2 to 50 torr, respectively.

While waiting for the gas pressure to stabilize, or preferably after the gas pressure has already stabilized, as shown in block 620 of FIG. 6, controller 180 applies a voltage difference between keeper 310 and the emitter assembly, which will be denoted by $V_{ke}$. Controller 180 gradually increases the value of $V_{ke}$ while monitoring the current flowing between keeper 310 and the emitter assembly, which will be denoted by $I_{ke}$. This process, termed "initial discharge control" is represented in block 630 of FIG. 6. The process terminates when there is a sudden sharp increase in $I_{ke}$, indicating the onset of plasma breakdown, as shown in block 640. The sudden sharp increase in $I_{ke}$ is typically a jump in the value of $I_{ke}$ from 0 amperes to over 100 milli-amperes occurring within 1 second or less. Typical values of $V_{ke}$ at which plasma breakdown occurs are in the range of 300 to 1000 volts.

Within a short time of detecting plasma breakdown, typically 100 microseconds or less, controller 180 implements emitter-keeper current control, as shown in block 650. The switch to emitter-keeper current control is preferably performed quickly in order to prevent continued ramping of $V_{ke}$, which may lead to excessively high values of $I_{ke}$ and to depletion of dopant material in electron emitter 350. In block 650, controller 180 monitors the emitter-keeper current $I_{ke}$, and adjusts the applied emitter-keeper voltage $V_{ke}$, so as to keep $I_{ke}$ at a predetermined current value which preferably is in a range of 100 to 150 milli-amperes. At this current level, there is a plasma glow discharge, which gradually heats electron emitter 350 to a temperature threshold needed for thermionic emission. Typical values of $V_{ke}$ during this step are from 200 to 300 volts.

It is important to note that heating of electron emitter 350 must be accomplished gradually by means of plasma glow discharge, and not suddenly, by electric arcing. Although the latter would require less time, it has been found to lead to emitter damage by overheating and melting at one or more points on the surface of electron emitter 350, causing cratering and erosion which lead to premature failure of electron emitter 350.

In block 660 of FIG. 6, controller 180 continues to monitor the value of $V_{ke}$ until there is a sudden drop in voltage, indicating an onset of thermionic emission. The onset of thermionic emission is preferably identified by a combination of two criteria on voltage $V_{ke}$: it must fall to values that are below a predetermined voltage threshold value, $V_{th}$, and it must remain below $V_{th}$ for a minimum time duration, $T_{th}$. Typical values of $V_{th}$ are 100 volts, more preferably 80 volts, and most preferably 50 volts. Typical values of $T_{th}$ are 1 second, more preferably 2 seconds, and most preferably 3 seconds.

Once thermionic emission has been achieved, controller 180 activates main discharge control, as indicated in block 670. Controller 180 applies a discharge voltage to initiate the flow of ionized gas through discharge channel 150. After several seconds, once the current of the main discharge circuit has stabilized, controller 180 sets $V_{ke}$ to zero, and HHC 200 continues to operate in its third mode of operation, namely, continuous, self-sustained cathode emission, as shown in block 680 of FIG. 6. The invention is particularly applicable to HHC's employing thermionic emission, which is typically required for applications in which the main discharge current is in excess of 200 milli-amperes, and particularly where it is in excess of 500 milli-amperes. Typical operating currents for the HHC of the present invention during self-sustained cathode emission may be around 1 ampere or greater, in various applications.

It will be appreciated that the above descriptions are intended only to serve as examples, and that many other embodiments are possible within the scope of the present invention as defined in the appended claims.

What is claimed is:

1. A heaterless hollow cathode apparatus comprising:

(a) an emitter assembly comprising an electron emitter and an emitter holder, said emitter assembly defining a gas flow path passing through an emitter orifice;

(b) a keeper surrounding said emitter assembly, said keeper having a keeper orifice;

(c) a gas flow regulator for supplying a regulated flow of gas through said gas flow path;

(d) an electrical power supply; and (e) a controller electrically associated with said electrical power supply, said gas flow regulator, said keeper, said emitter assembly, and said controller being configured sequentially to:

(i) apply an emitter-keeper voltage between said emitter assembly and said keeper while gas is supplied to a volume between said emitter assembly and said keeper to initiate a discharge between said emitter assembly and said keeper;

(ii) monitor the value of an emitter-keeper current, flowing between said emitter assembly and said keeper, and adjust said emitter-keeper voltage so as to maintain said emitter-keeper current at a predetermined current value;

(iii) monitor said emitter-keeper voltage so as to detect a drop in said emitter-keeper voltage to values which remain below a predetermined voltage threshold for a predetermined minimum time duration;

(iv) actuate a main discharge circuit in which current flows from an anode to the heaterless hollow cathode; and (v) set said emitter-keeper voltage to zero.

2. The heaterless hollow cathode apparatus of claim 1, wherein said emitter holder comprises an emitter holder neck which encapsulates said electron emitter.

3. The heaterless hollow cathode apparatus of claim 1, wherein an area of said keeper orifice is between 5% and 25% of an area of said emitter orifice.

4. The heaterless hollow cathode apparatus of claim 1, wherein said keeper comprises a change in thickness.

5. The heaterless hollow cathode apparatus of claim 1, wherein said electron emitter comprises a refractive ceramic material.

6. The heaterless hollow cathode apparatus of claim 1, wherein said electron emitter comprises a refractive metal impregnated with an oxide.

7. The heaterless hollow cathode apparatus of claim 1, wherein said electron emitter has a work function less than 2.2 electron volts.

8. The heaterless hollow cathode apparatus of claim 1, wherein said controller detects initiation of said discharge between said emitter assembly and said keeper by identifying a sudden sharp increase in said emitter-keeper current.

9. The heaterless hollow cathode apparatus of claim 1, wherein said predetermined current value is in a range of 100 to 150 milli-amperes.

10. The heaterless hollow cathode apparatus of claim 1, wherein said predetermined voltage threshold is in a range of 50 to 100 volts.

11. The heaterless hollow cathode apparatus of claim 1, wherein said predetermined minimum time duration is in a range of 1 to 3 seconds.

12. A method for operating a heaterless hollow cathode, comprising the steps of:

(i) providing a controller electrically associated with an electrical power supply, a gas flow regulator, a keeper, and an emitter assembly;

(ii) applying an emitter-keeper voltage between said emitter assembly and said keeper to initiate a discharge between said emitter assembly and said keeper;

(iii) monitoring a value of an emitter-keeper current, flowing between said emitter assembly and said keeper, and adjusting said emitter-keeper voltage so as to maintain said emitter-keeper current at a predetermined current value;

(iv) monitoring said emitter-keeper voltage so as to detect a drop in said emitter-keeper voltage to values which remain below a predetermined voltage threshold for a predetermined minimum time duration;

(v) actuating a main discharge circuit in which current flows from an anode to the heaterless hollow cathode; and (vi) setting said emitter-keeper voltage to zero.

13. The method according to claim 12 wherein said controller detects initiation of said discharge between said emitter assembly and said keeper by identifying a sudden sharp increase in said emitter-keeper current.

14. The method according to claim 12 wherein said predetermined current value is in a range of 100 to 150 milli-amperes.

15. The method according to claim 12 wherein said predetermined voltage threshold is in a range of 50 to 100 volts.

16. The method according to claim 12 wherein said minimum time duration is in a range of 1 to 3 seconds.

* * * * *